United States Patent [19]

Scrufari

[11] 4,041,633

[45] Aug. 16, 1977

[54] DUAL-BARREL PISTOL

[76] Inventor: Pascal Scrufari, 457 12th St., Niagara Falls, N.Y. 14303

[21] Appl. No.: 616,139

[22] Filed: Sept. 24, 1975

[51] Int. Cl.[2] ..... F41C 1/00

[52] U.S. Cl. ..... 42/65; 42/59

[58] Field of Search ..... 42/59, 65

[56] References Cited

U.S. PATENT DOCUMENTS

| | | | |
|---|---|---|---|
| 191,178 | 5/1877 | Richardson | 42/59 |
| 235,240 | 12/1880 | Hood | 42/65 |
| 627,966 | 7/1899 | Behr | 42/59 |
| 943,819 | 12/1909 | DuBose | 42/59 |
| 990,669 | 4/1911 | Rodehaver | 42/59 |
| 1,042,145 | 10/1912 | Rodehaver | 42/59 |
| 3,093,922 | 6/1963 | Ivy | 42/59 |

*Primary Examiner*—Charles T. Jordan
*Attorney, Agent, or Firm*—Ashlan F. Harlan, Jr.

[57] ABSTRACT

A pistol of the revolver type having two vertically spaced barrels having bores of different diameters, a cylinder having chambers for two different sized cartridges, the bullets therein being adapted to fit, respectively, the barrels of different diameter, and means for selectively firing cartridges in said cylinder chambers.

15 Claims, 6 Drawing Figures

DUAL-BARREL PISTOL

BACKGROUND OF THE INVENTION

The invention of the present application relates to pistols and is particularly concerned with pistols of the revolver type having two barrels, whereby cartridges of two different calibers can be loaded and selectively fired.

It has been previously suggested that pistols of the revolver type be so constructed as to permit the firing, either alternatively or simultaneously, of cartridges of two different calibers, a separate barrel being provided for each size. Examples of such constructions are shown in U.S. Pat. Nos. 1,042,145; 990,669; 3,173,221; 627,966; and 235,240. In general, however, these prior art constructions have not been satisfactory and there has been a desire for a more satisfactory dual-caliber handgun.

It is, therefore, an object of the present invention to provide a pistol of the revolver type which can be loaded with a plurality of cartridges of each two different calibers that is adapted for firing, selectively, cartridges of both calibers, and which is also reliable, convenient to use, and so balanced as to facilitate accurate shooting.

Summary of the Invention

The above-mentioned object is achieved by providing a pistol of the revolver type in which the cylinder has chambers for two sizes of cartridges and which is provided with two, vertically aligned barrels, the upper barrel having a bore corresponding to te diameter of the smaller bullet and the lower barrel having a bore to fit the larger bullet. The two barrels are located, respectively, above and below the axis of the cylinder and are aligned with the respective small and large chambers of the cylinder when the gun is to be fired. Two firing pins are provided, one for each size of shell. The firing pins are actuated by a floating hammer block that is engaged by the hammer of the pistol when the trigger is pulled and which is movable selectively to engage and depress one or the other of the firing pins when the block is struck. The essential action of a revolver is unchanged. The mechanism of the novel revolver differs in that a second barrel integral with the frame is provided, a cylinder chambered for more, and for two, different sized, cartridges is provided, and a hammer block, firing pins, and firing pin selector are added. Accuracy is enhanced by locating the barrel with the larger bore below the other one and below the axis of the cylinder, since this reduces barrel flip during firing.

The terms "upper," "lower," "top," "bottom," "right," "left," "above," "below," "vertical," and "horizontal," and similar terms of position and/or direction as used hereinafter refer to the illustrations in the drawings, but are used only for convenience in description and/or reference. Such terms should not be so construed as to imply a necessary positioning of the structure or portions thereof or to limit the scope of this invention.

SHORT DESCRIPTION OF THE DRAWINGS

DESCRIPTION OF THE INVENTION

Figure 1:
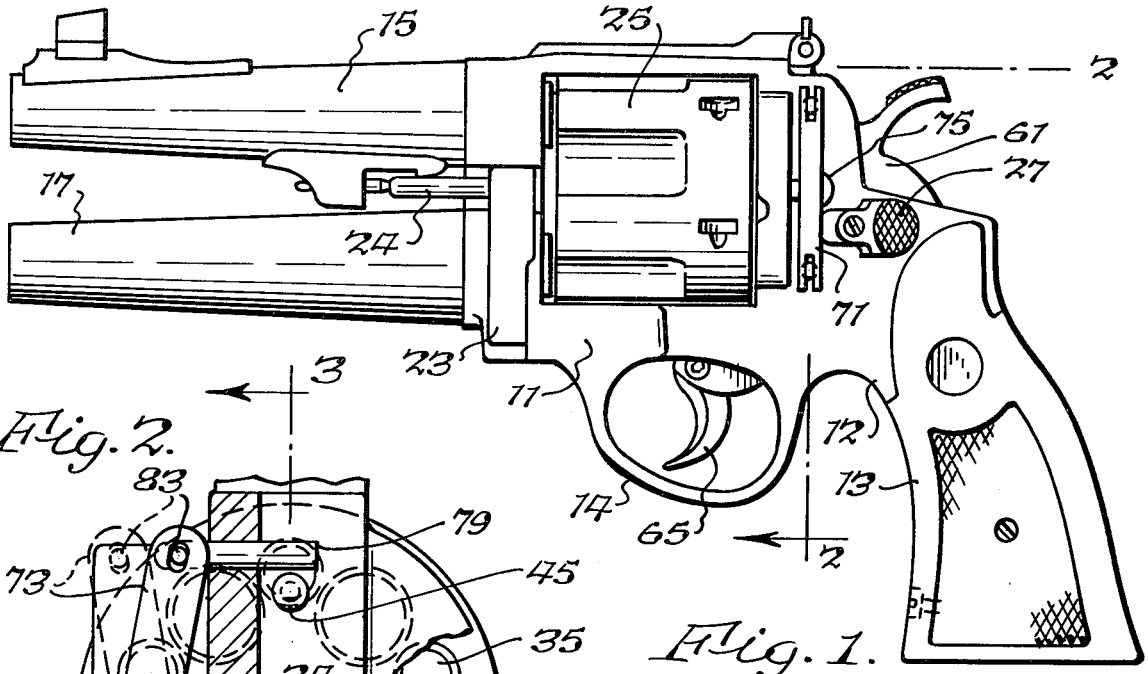
FIG. 1 is a side view of a revolver type pistol embodying the invention of the present application.

FIG. 1 depicts a dual-barrel revolver according to the present invention. It comprises a frame 11 that is provided with a grip section 12 having opposed, detachable stocks 13, and a trigger guard 14, both preferably formed integrally with said frame, and with a pair of vertically aligned but spaced barrels 15 and 17 projecting forwardly which may be integral with said frame. It will be understood that the novel revlover, as shown, is based on a standard Smith and Wesson revolver and has in common therewith many constructional features. However, the present invention is not limited to the use of a Smith and Wesson frame or action and revolvers incorporating features of the invention can embody a Colt or other type of frame or action.

Reverting to FIG. 1, the frame 11 has pivotally mounted thereon an arm or yoke 23 in which there is rotatably mounted a shaft 24 which carries for rotation therewith a cylinder 25. The latter may thus, upon activation of the cylinder release 27 which is provided on the frame, be swung forwardly from the position shown in FIG. 1 to permit loading and unloading the chambers thereof.

Figure 2:
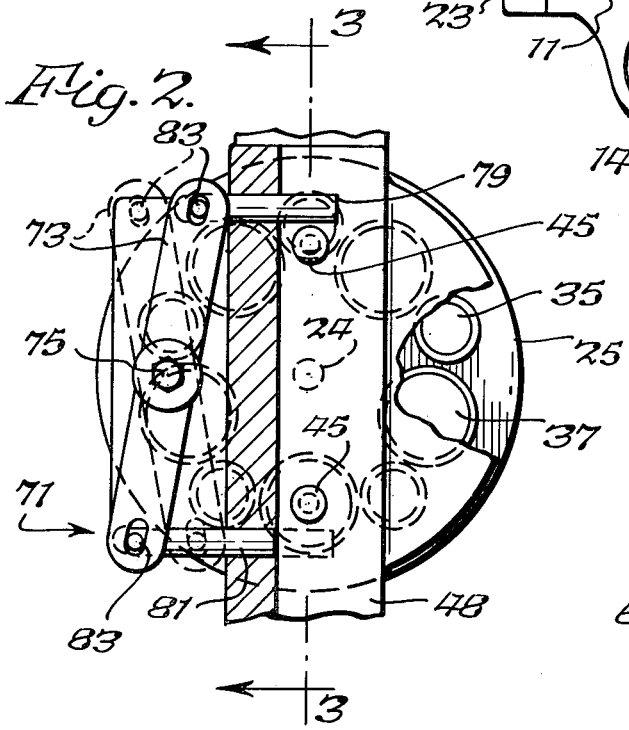
FIG. 2 is a fragmentary, enlarged, vertical, sectional view, taken on the line 2—2 of FIG. 1.
Figure 3:
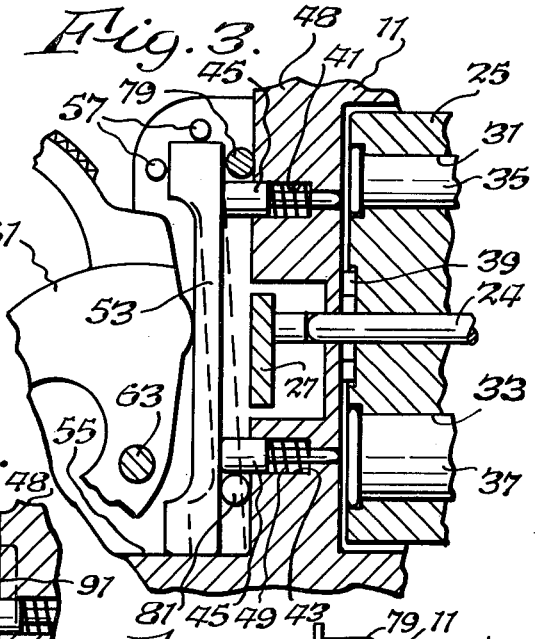
FIG. 3 is a fragmentary, vertical , sectional view, taken on the line 3—3 of FIG. 2.

As more clearly shown in FIGS. 2 and 3, the cylinder 25 is provided with a plurality of chambers 31 and 33 which are arranged alternately. The smaller chambers 31 are equidistantly spaced about an imaginary circle having its center on the axis of the cylinder 25. The larger chambers 33 are similarly spaced about an imaginary circle of slightly smaller diameter, having its center on the cylinder axis, and are located between the smaller chambers 31. Thus, the cylinder is provided with two sets of alternately arranged chambers for cartridges. The small chambers 31, adpated to hold the cartridges 35 of smaller caliber, can be aligned with the barrel 15 of smaller bore and the larger chambers 33, adapted to hold the cartridges 37 of larger caliber, can be aligned with the barrel 17 of larger bore when the cylinder 25 is closed and is revolved, either by hand or by operation of a cylinder indexing mechanism (partially shwon at 39).

Wells or bores 41 and 43 are provided in the breech portion 48 of the frame 11 to receive firing pins 45. Each of the firing pins 45 comprises a base portion slidably fitting one of the bores 41 and 43 and in inwardly projecting extension of smaller diameter. The firing pin extensions have sharpened ends that are slidable in bores coaxial with the wells 41 and 43 and which are adapted to contact the ends of the cartridges or shells in the cylinder chambers. Small compression springs 49 that surround the firing pin extensions in the bores 41 and 43 normally maintain the pins 45 in retracted position with the outer ends or base portions thereof in contact with an elongated hammer block 53 that is arranged substantially vertically to the left of the firing pins 45 in FIG. 3. The hammer block 53 can be said to float since the lower end thereof merely rests on a ledge 55 of the frame 11 and the upper end thereof is maintained in a generally vertical position by the pins 57 that are carried by the frame and extend inwardly from the side face thereof.

Figure 6:
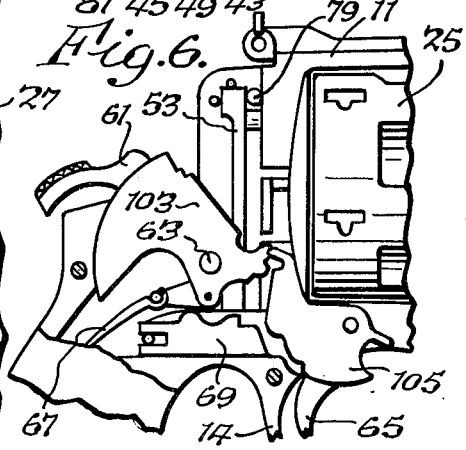
FIG. 6 is a fragmentary, elevational view, with parts broken away, of the side of the pistol not shown in FIG. 1.

The hammer block 53 is struck by the hammer 61 when the revolver is discharged. The hammer is pivoted inside the frame 11 on a pin, as shown at 63, and is interconnected (as shown in FIG. 6) with the trigger 65, whereby after cocking, i.e. pulling the hammer back, the hammer is released by trigger movement and, by action of a spring 67 within the frame, is caused to strike the hammer block 53. A barrel selector, comprehensively designated 71, is provided to permit selective firing of a small caliber bullet through the upper barrel or a large caliber bullet through the lower barrel.

As shown in FIGS. 1 - 3, the barrel selector 71 comprises a lever 73 pivoted at approximately its midpoint on a stud or bolt 75, engaged in the breech portion 48 of the frame parallel to the barrels of the revolver. The lever 73 carries adjacent its ends short fulcrum rods 79 and 81. Each of these fulcrum rods is joined to the lever 73 by a pin and slot connection 83 and extends through and is guided in vertically spaced, horizontal holes in the side of the frame 11. The fulcrum rods are selectively movable in said holes by the lever 73 to project one rod or the other in front of the hammer block 53. Thus, as shown in FIGS. 2 and 3, the upper fulcrum rod 79 lies between the floating hammer block 53 and the breech portion 48 of the frame 11 while the lower fulcrum rod 81 is withdrawn.

When, therefore, the hammer block 53 is struck by the falling hammer 61 the lower end of the block is forced inwardly against the lower firing pin 45, as shown in broken lines in FIG. 3, and a cartridge 37 in the cylinder aligned with the lower barrel 17 is fired. The upper fulcrum rod 79 prevents substantial movement of the upper firing pin. Conversely, when the lever 73 is pivoted to project the fulcrum rod 81 between the hammer block 53 and the breech portion 48 of the frame, as shown in broken lines in FIG. 2, the pin 79 is withdrawn and impact of the hammer 61 on the hammer block 53 will result in the upper firing pin 45 firing a cartridge 35 aligned with the upper, smaller diameter barrel 15.

Figure 4:
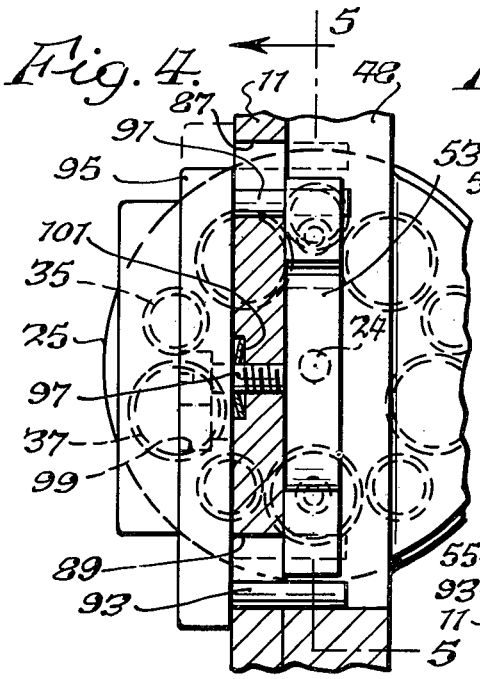
FIG. 4 is a fragmentary, vertical, sectional view, similar to FIG. 2, illustrating a modified construction.
Figure 5:
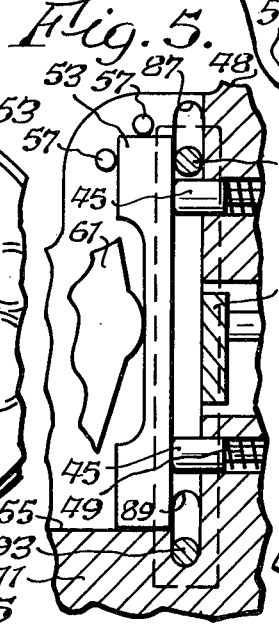
FIG. 5 is a fragmentary, vertical, sectional view, similar to FIG. 3, taken on the line 5—5 of FIG. 4.

A modified barrel selector mechanism is illustrated in FIGS. 4 and 5. In this modification the side wall of the frame 11 is provided with vertically spaced, aligned slots 87 and 89 in which fulcrum rods 91 and 93, respectively, are vertically slidable. The latter are attached by suitable means (not shown), such as threading, to a vertically slidable plate 95 that is held to the frame 11 by a threaded bolt or stud 97 movable in a slot 99 through the plate 95. The fulcrum rods 91 and 93 are positioned adjacent the ends of the plate 95 at such a distance that, as shown in FIG. 4 by broken lines, the plate can be moved to selectively dispose one or the other of said rods between the hammer block 53 and the breech portion 48 of the frame 11. Accordingly, the hammer 61 on striking the hammer block will cause firing of a cartridge 37 aligned with the lower barrel 17 when the plate 95 is in the position shown in full lines and will cause firing of a cartridge 35 aligned with the upper barrel 15 when the plate 95 is in the position shown in broken lines. A spring washer 101 is provided to maintain the slidable plate 95 in adjusted position.

It will be seen that the chambers 31 and 33 FIGS. 2 and 3 are shown with cartridges 35 and 37, respectively, therein. In a prototype, the cartridges 35 are .22 caliber, while the cartridges 37 are .38 caliber. Since virtually all .22 cartridges are rim fire, the upper firing pin 45 is not concentric with the chambers 31, but is offset (as shown in FIG. 3) so as to contact the rim of the cartridge casing when it is actuated by the hammer block 53. On the other hand, larger caliber cartridges are, in almost all cases, center fire and the lower firing pin is therefore concentric with the chambers 33. It will be understood that the cylinder 25 can be chambered for other sizes of cartridges, if desired. However, the distance between the firing pins must be matched to the distance between diametrically opposite chambers and adjusted for center fire or rim fire shells, as the case may be.

The novel revolver of the present invention is simple and easy to use. After the chambers 31 and 33 in the cylinder 25 are filled with cartridges of the appropriate sizes, the barrel selector is moved into position to permit firing of either large bullets through the lower barrel 17 or small bullets through the upper barrel 15. When it is desired to fire one or more bullets of the other size, it is only necessary to shift the barrel selector and rotate the cylinder to align an unfired cartridge of that size with the appropriate barrel.

As pointed out above, the invention of the present application is adapted for use with revolvers that have different types of actions, although the illustrated embodiment is basically a Smith and Wesson action. It is also made clear that in providing the hammer block, two firing pins, and a selector mechanism, which are essentials of applicant's invention, there is necessarily some rearrangement or re-positioning of a portion of the normal firing mechanism required. FIG. 6 illustrates an example of such rearrangement in which the hammer 61 and trigger 65 are modified by forming the cooperating portions thereof, 103 and 105, repsectively, on their forwardly facing sides, adn the rebound slide 69 is moved to cooperate with the hammer and trigger. Thereby the cocking and firing action of the pistol is substantially unchanged. It will be understood that other modifications can be made.

It will be apparent that the present invention may be used with either single or double action revolvers and that modifications and changes from the particular construction shown and described may be made without departing from the spirit of the present invention.

I claim:

1. In a pistol of the revolver type having a frame adapted for mounting a cylinder for holding cartridges, means for indexing said cylinder, a trigger, and a hammer interconnected with said trigger, the combination of two vertically spaced barrels with bores of different sizes, said barrels being attached to said frame; a rotatable cylinder carried by said frame having a plurality of chambers adapted to hold cartridges with bullets fitting each of said bores, said chambers being alignable with said barrels; a pair of firing pins carried in said frame, said firing pins being vertically spaced and adapted to fire cartridges in chambers of said cylinder aligned with said barrels; a hammer block engaging said firing pins and adapted to be struck by said hammer to produce firing of said cartridges; and barrel selecting means, movable with respect to said hammer block, for selectively preventing substantial movement of one or the other of said firing pins by said hammer block.

2. A pistol as defined in claim 1 wherein the lower of said barrels has a bore of larger size than the upper barrel and is below the axis of said cylinder.

3. A pistol as defined in claim 2 wherein said barrels are integral with said frame.

4. A pistol as defined in claim 2 wherein the chambers in said cylinder are arranged with the larger diameter chambers alternating with the smaller diameter chambers.

5. A pistol as defined in claim 4 wherein said chambers of larger diameter are arranged in a circle and said chambers of smaller diameter are arranged in a circle of radius greater than said first-mentioned circle.

6. A pistol as defined in claim 1 wherein said barrel selecting means comprises a pair of fulcrum rods and said rods may be selectively moved to provide a fulcrum about which said hammer block pivots when struck by said hammer, said fulcrum being adjacent the upper end of said hammer block when the lower of said firing pins is to be actuated and being adjacent the lower end of said hammer block when the upper firing pin is to be actuated.

7. A pistol as defined in claim 3 wherein the chambers in said cylinder are arranged with the larger diameter chambers alternating with the smaller diameter chambers.

8. A pistol as defined in claim 7 wherein said chambers of larger diameter are arranged in a circle and said chambers of smaller diameter are arranged in a circle of radius greater than said first-mentioned circle.

9. A pistol as defined in claim 2 wherein said barrel selecting means comprises a pair of fulcrum rods and said rods may be selectively moved to provide a fulcrum about which said hammer block pivots when struck by said hammer, said fulcrum being adjacent the upper end of said hammer block when the lower of said firing pins is to be actuated and being adjacent the lower end of said hammer block when the upper firing pin is to be actuated.

10. A pistol as defined in claim 5 wherein said barrel selecting means comprises a pair of fulcrum rods and said rods may be selectively moved to provide a fulcrum about which said hammer block pivots when struck by said hammer, said fulcrum being adjacent the upper end of said hammer block when the lower of said firing pins is to be actuated and being adjacent the lower end of said hammer block when the upper firing pin is to be actuated.

11. A pistol as defined in claim 10 wherin said barrels are integral with said frame.

12. A pistol as defined in claim 1 wherein each of said chambers is alignable with only one of said barrels.

13. A pistol as defined in claim 2 wherein each of said chambers is alignable with only one of said barrels.

14. A pistol as defined in claim 10 wherein each of said chambers is alignable with only one of said barrels.

15. A pistol as defined in claim 5 wherein said barrel selecting means comprises a pair of movable fulcrum rods.

* * * * *